US005855196A

United States Patent [19]

Hawley

[11] Patent Number: 5,855,196

[45] **Date of Patent: *Jan. 5, 1999**

[54] ADJUSTABLE AUTOMATIC STARTING LINE THROTTLE ACTUATION CONTROLLER

[75] Inventor: Frank Hawley, La Verne, Calif.

[73] Assignee: Curtis E. Rodden, Titusville, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 671,328

[22] Filed: Jun. 27, 1996

[51] Int. Cl.[6] ..... F02D 11/08

[52] U.S. Cl. ..... 123/398; 123/342; 123/360

[58] Field of Search ..... 123/398, 396, 123/399, 400, 401, 342, 360

[56] References Cited

U.S. PATENT DOCUMENTS

| | | | |
|---|---|---|---|
| 4,524,741 | 6/1985 | Corbi | 123/342 |
| 4,784,099 | 11/1988 | Noe et al. | 123/398 |
| 5,235,948 | 8/1993 | Grant et al. | 123/342 |

*Primary Examiner*—Willis R. Wolfe
*Assistant Examiner*—Hieu T. Vo
*Attorney, Agent, or Firm*—Brian S. Steinberger; Law Offices of Brian S. Steinberger

[57] ABSTRACT

An apparatus for automatically controlling the activation of the throttle on a carburetor on the engine of a drag race car before the start of the race while staging the car. The apparatus eliminates some of the tasks a driver must perform during the process of staging and launching a race vehicle on the starting line(such as physically depressing the throttle pedal) using a starting line throttle actuation system for Pro tree and Full tree modes for controlling the throttle opening. In both Pro and Full tree modes, the staging process is simplified by allowing the driver to stage with the throttle pedal pre-depressed in the wide open down position, with the actual opening of the throttle controlled by the starting line throttle actuation control system. The apparatus has the driver use the same staging procedure for both Pro tree and Full tree races, thus eliminating separate training that has been required for Pro and Full tree races. The apparatus automatically controls the timing and opening rate of the throttle, eliminates driver error in failing to open the throttle at the correct time in response to the race start signal, and reduces or eliminates engine stumble caused by applying the throttle too quickly.

13 Claims, 2 Drawing Sheets

ADJUSTABLE AUTOMATIC STARTING LINE THROTTLE ACTUATION CONTROLLER

CROSS-REFERENCE TO RELATED APPLICATIONS

This invention includes art that is included in a co-pending application Ser. No. 08/671,207 filed on Jun. 27, 1996 by the same inventor thereof, titled Adjustable Automatic Throttle Actuation Controller.

BACKGROUND OF THE INVENTION

1. Field of the Invention

The present invention relates to an adjustable automatic starting line throttle actuation controller for use with a drag race car using an internal combustion engine to control the opening of the throttle to maintain a preset low rpm before the start of a drag race while the driver is holding the throttle open while staging the drag race car.

2. Background of the Invention

In drag racing drivers must bring their race car under control to the starting line until the front tires of the race car break a prestage infrared light beam and a stage infrared light beam so each infrared light beam turns on a set of amber light bulbs on the starting line tree to show the driver the car is properly staged at the starting line. This is difficult because there are a number of tasks the driver must perform while staging properly. In addition staging must be done quickly so the driver can have a second to mentally prepare for the start of the race before the starter turns on the lights that signal the start.

Most drivers who race with a pro tree follow the same starting line procedure. They raise the engine rpm slightly at pre stage, creep into the stage beam, stop, set the transmission brake button, open the throttle, wait for the tree to signal the start of the race, and release the transmission brake button when the tree is activated. Problems that drivers have when staging a drag race car with a pro tree include not getting the throttle fully applied and the engine to full rpm before the start signal, the engine may stumble as the throttle is applied too quickly, and the driver may be inconsistent in starting reaction time because of the short time to open the throttle and get mentally ready to start the race.

Starting a race with a full tree is slightly different and many drivers do the following: pull into the stage beam, stop, set the transmission brake button, apply full throttle and hold the engine on the rpm limiter, and release the transmission brake button on the top bulb when the tree is activated. The problems the driver has with this method is the engine may not come to a full rpm smoothly when the throttle is applied and the driver has to hold the engine on full rpm for a long time on the rpm limiter. Sometimes drivers who are slow at staging are surprised by the tree being activated quickly before they are fully ready. Drivers may become concerned about this and rush during the staging process and lose their mental preparedness for the race. Drivers who don't have the throttle open when the tree is activated quickly may cause the engine to stumble when they open the throttle too quickly.

Accordingly, a heretofore unaddressed need exists for a starting line throttle actuation controller that can control the amount, speed, and timing of the throttle opening, and can reduce the number of tasks that a driver has to perform to properly stage a drag race car.

There is no prior art that addresses the problems of controlling the throttle opening during the staging of a drag race car prior to the start of a race except the throttle pedal that controls the opening of the carburetor.

OBJECTS AND ADVANTAGES

Accordingly, several objects and advantages of my invention are it will allow a drag race car driver to be more consistent at the starting line by reducing the number of tasks that need to be done to stage the race car and allowing the driver to maintain a clear mind to concentrate on the start of the race and not on making extra movements in the race car. It will eliminate the possibility of a driver not having the engine rpm high when the race starts because the engine will automatically go to full throttle when it is needed. It will eliminate engine stumble on the starting line by applying the throttle automatically, smoothly and when it is required to be at full throttle. Further objects and advantages of my invention will become apparent from a consideration of the drawings and ensuing description.

SUMMARY OF THE INVENTION

Briefly described, the present invention comprises, in a preferred embodiment thereof, a starting line throttle actuation controller including a piston/cylinder assembly connected to the throttle linkage of an engine of a drag racing car, which is controlled by an electronic activation assembly which causes the piston rod to extend and retract to open and close the throttle linkage, a starting line throttle actuation controller assembly which limits the distance the piston rod can extend, and a source of compressed gas which causes the piston rod to retract into the piston/cylinder assembly.

When the mode switch is set to pro tree mode, and the driver activates the system by pressing the arm switch and opens the throttle, the electronic activation assembly turns off the source of compressed gas to the piston/cylinder assembly and the piston rod extends from the piston/cylinder assembly causing the throttle linkage to close to a preset limit allowing the driver to stage the drag race car at a preset rpm using only the foot brake in the drag race car. The starting line piston rod travel limiting assembly functions to stop the extension of the piston rod from the piston/cylinder assembly at a preset adjustable position. When the transmission brake button is pressed the electronic activation assembly causes the source of compressed gas to be turned on and the compressed gas flows into the piston/cylinder assembly and the piston rod retracts into the piston/cylinder assembly causing the throttle to open and increase the rpm of the engine. This allows the driver to stage the race car at an a low preset rpm while holding the throttle pedal open and automatically leave the starting line at full throttle.

When the mode switch is set to full tree mode, and the driver activates the system by pressing the arm switch the electronic activation assembly turns off the source of compressed gas to the piston/cylinder assembly and the piston rod extends from the piston/cylinder assembly. When the driver presses the throttle pedal the throttle opening cannot exceed the preset limit. This allows the driver to stage the drag race car at a preset rpm using only the foot brake in the drag race car. The starting line piston rod travel limiting assembly functions to stop the extension of the piston rod from the piston/cylinder assembly at a preset adjustable position. After the driver has staged the car, when the transmission brake button is pressed the electronic activation assembly does not affect the source of compressed gas and the throttle opening remains at the preset level. When the transmission brake button is released by the driver at the start of the race it causes the source of compressed gas to be turned on after a preset time delay and the compressed gas flows into the piston/cylinder assembly and the piston rod retracts into the piston/cylinder assembly causing the throttle to open and increase the rpm of the engine. This allows the driver to stage the race car at a low preset rpm while holding the throttle pedal open and automatically leave the starting line at full throttle. The driver presets an adjustable time delay in the electronic activation assembly prior to starting the race in order to minimize the amount of time the engine is at full throttle, especially when racing slower opponents.

DESCRIPTION OF THE INVENTION

Figure 1:
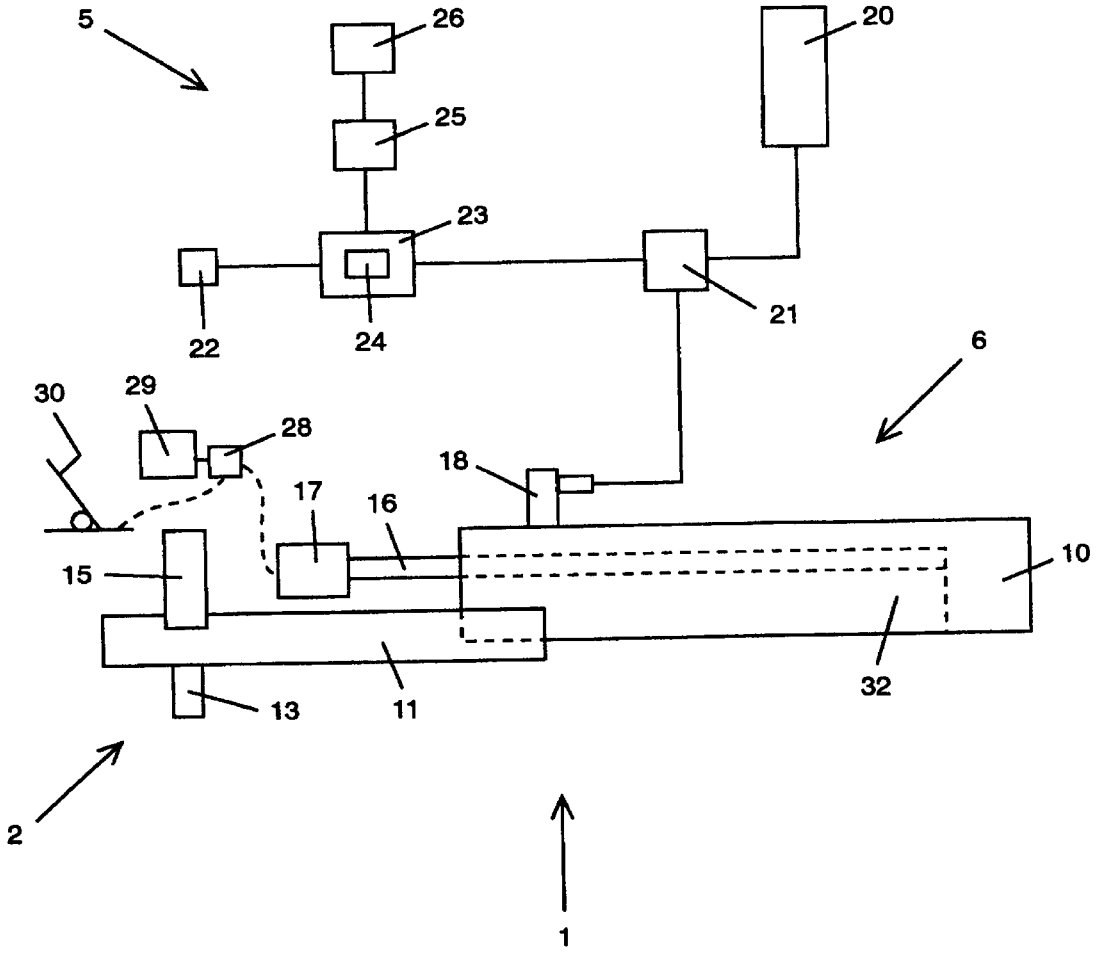
FIG. 1 is a diagrammatic view of the adjustable automatic starting line throttle actuation controller constructed in accordance with a preferred embodiment of the present invention.

Referring now in more detail to the drawings, in which like numerals represent like parts throughout the several views, FIG. 1 illustrates an adjustable automatic starting line throttle actuation controller 1 that embodies the principles of the present invention in a preferred form. The adjustable automatic starting line throttle actuation controller 1 comprises generally a piston/cylinder assembly 6, a starting line piston rod travel limiting assembly 2, an electronic activation assembly 5, and a source of compressed gas 20. The carburetor linkage 28 is shown connected to the ball connector 17 and the throttle pedal 30.

The source of compressed gas has a control valve which is open and is connected to the solenoid 21. The electronic shut off box 23 includes a mode switch 24 which can be set at pro tree mode or full tree mode. The arm switch 25 is interconnected between the 12 volt power source 26 and the electronic shut off box 23. The transmission brake button 22 is connected to the electronic shut off box. "The electronic activation assembly includes switches for setting a time delay in Full tree mode, and an arm/fault indicator light."

When the mode switch 24 is in pro tree mode depression of the arm button 25 causes the electronic control box 23 to cause the solenoid 21 to allow compressed gas to exhaust through the adjustable flow control valve 18 and out of the cylinder 10 causing the piston rod 16 to extend from the cylinder 10. As the piston rod 16 extends from the cylinder 10 the ball connector 17 interconnected between the piston rod 16 and the carburetor linkage 28 causes the throttle to adjust to a preset partial opening when the throttle pedal 30 is held in the full throttle position. The starting line piston rod travel limiting assembly 2 includes a piston rod travel adjuster 15 which can be adjusted by allowing it to travel in the slot 12 in the mounting bar 11 and securely locked into a desired distance from the cylinder 10 by using the adjustment screw 13 and functions to stop the extension of the piston rod 16 and ball connector 17. When the transmission brake button 22 is depressed the electronic shut off box 23 causes the solenoid 21 to turn on the flow of compressed gas from the source of compressed gas 20 and to flow through the adustable flow control valve 18 and into the cylinder 10 which causes the piston rod 16 with the attached ball connector 17 to retract into the cylinder 10 and which opens the carburetor linkage 28 which increases the rpm of the engine which is controlled by the throttle pedal 30 which is held at full throttle.

When the mode switch 24 is in full tree mode activation of the arm switch 25 causes the electronic shut off box 23 to cause the solenoid 21 to allow compressed gas to flow through the adjustable flow control valve 18 and out of cylinder 10 causing the piston rod 16 to extend from the cylinder 10 and as the piston rod 16 extends from the cylinder 10 the ball connector 17 interconnected between the piston rod 16 and the carburetor linkage 28 causes the throttle to adjust to a preset partial opening even when the throttle pedal 30 is held in the full throttle position. The piston rod travel adjuster 15 limits the travel of the piston rod 16 and ball connector 17. When the transmission brake button 22 is depressed the electronic shut off box does not affect the flow of compressed gas and the throttle stays at the preset level. When the transmission brake button 22 is released it causes the electronic shut off box to cause the solenoid 21 to turn on after a preset time delay which causes the flow of compressed gas from the source of compressed gas 20 and through the adjustable flow control valve 18 and into the cylinder 10 which causes the piston rod 16 with the attached ball connector 17 to retract into the cylinder 10 and which opens the carburetor linkage 28 which increases the rpm of the engine which is controlled by the open throttle pedal 30 which is held at full throttle.

Figure 2:
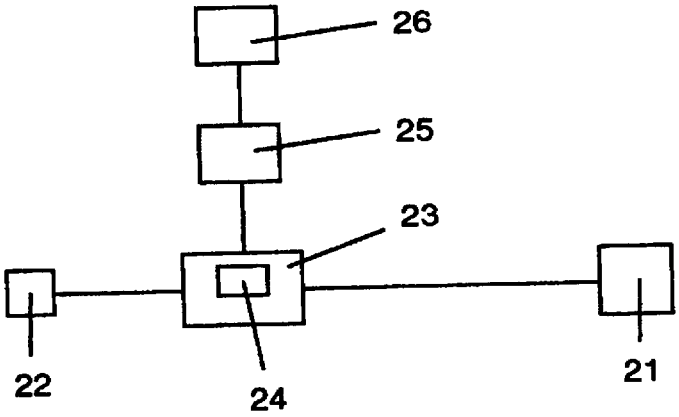
FIG. 2 is a diagrammatic view of the electronic activation assembly of FIG. 1.

FIG. 2 is a diagrammatic view of the electronic activation assembly 5. The electronic activation assembly 5 comprises a 12 volt power source 26 connected to an arm switch 25 which is connected to an electronic shut off box 23 that includes a mode switch 24 that allows the driver to activate a pro tree mode or full tree mode. The electronic shut off box is connected to a solenoid 21 which allows the flow of compressed gas to the cylinder 10 or from the cylinder 10 and then vents the compressed gas to the atmosphere. The transmission brake button 22 is connected to the electronic shut off box and causes the electronic control box 23 to activate the solenoid 21 to allow the flow of compressed gas from the source of compressed gas 20 or to be vented from the cylinder 10.

Figure 3:
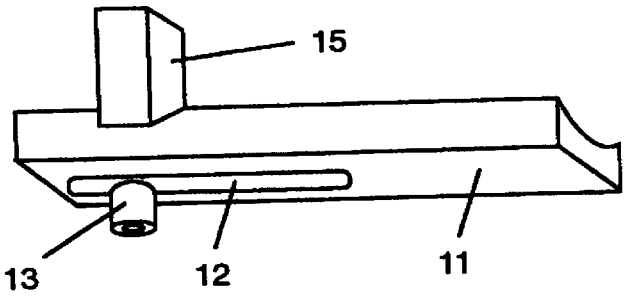
FIG. 3 is a perspective view of the starting line piston rod travel limiting assembly of FIG. 1.

FIG. 3 is a perspective view of the starting line piston rod travel limiting assembly 2 which comprises a mounting bar 11 with a adjustment slot 12 into which is mounted a piston rod travel adjuster 15 that projects above the mounting bar 11 and is used to limit the extension of the piston rod 16 and ball connector 17. The piston rod travel adjuster 15 is set a predetermined distance from the end of the cylinder 10 and the distance can be adjusted to one-thousandths of an inch using a measuring device such as calipers and fastened or adjusted into place using the adjustment screw 13.

Thus, it can be seen that the adjustable automatic starting line throttle actuation controller 1 functions as a means to automatically adjust the engine throttle to a preset limit or to full throttle during the staging of a drag race car prior to the start of a race. Likewise, it can be seen that the starting line piston rod travel limiting assembly 2 functions as a means for accurately presetting and limiting the amount that the carburetor linkage opens the carburetor from full throttle to a preset partial throttle opening.

Making the starting line throttle actuation controller adjustable allows a racer to hold the throttle pedal open and reduce the number of tasks that must be performed during staging while staging in a controlled manner at a lower engine rpm, and making the starting line throttle actuation controller automatic allows the racer to focus on the start of the race rather than be concerned about the start lights coming on too fast or doing too many tasks and allows the engine to come to full throttle automatically and smoothly when it is required.

Although the description above contains many specificities, these should not be constructed as limiting the scope of the invention but as merely providing illustrations of some of the presently preferred embodiments of this invention. For example, the piston rod travel limiting assembly can have other shapes, such as rounded sides or bottom; the slot can be longer or wider; the adjustment screw can be a different shape or have a shape or slots so it can be tightened with a wrench, screwdriver, hex wrench, or other tool or be tightened by hand; the ball connector can be a different shape or configuration and attach to the carburetor linkage by different means.

Thus the scope of the invention should be determined by the appended claims and their legal equivalents, rather than by the examples given.

LIST OF REFERENCE NUMBERS

1 adjustable starting line automatic throttle actuation controller
2 starting line piston rod travel limiting assembly
5 electronic activation assembly
6 piston/cylinder assembly
10 cylinder
11 mounting bar
12 adjustment slot
13 adjustment screw
15 piston rod travel adjuster
16 piston rod
17 ball connector
18 adjustable flow control valve
19 connection to throttle cable
20 gas source
21 solenoid
22 transmission brake button
23 electronic control box
24 mode switch
25 on/off switch
26 12 volt power source
28 carburetor linkage
29 carburetor
30 throttle pedal
32 piston
33 connection to throttle pedal

I claim:

1. An activation switch apparatus for allowing a driver of a drag racing vehicle to switch from a pro tree mode to a full tree mode during a pre-race staging process, comprising:

a selection switch having a pro tree mode and a full tree mode for staging of a race vehicle prior to a race;

a cylinder having a piston for controlling an open position and a selected partial close position of a throttle; and a hand actuated switch for locking a race vehicle in place, wherein the pro tree mode allows the hand actuated switch to immediately adjust the cylinder from the selected partial close position to the open position of the throttle, and the full tree mode allows the cylinder to move to the open position of the throttle after a selected delay from the release of the hand actuated switch.

2. The activation switch apparatus for allowing a driver of a drag racing vehicle to switch from a pro tree mode to a full tree mode during a pre-race staging process of claim 1, wherein the activation switch includes:

a mode selection on and off switch for switching between a pro tree setting and a full tree setting.

3. The activation switch apparatus for allowing a driver of a drag racing vehicle to switch from a pro tree mode to a full tree mode during a pre-race staging process of claim 1, wherein the hand actuated switch includes:

a button for controlling a brake of the vehicle, wherein pressing the button activates the vehicle brake, and wherein releasing the button causes the brake to be released and allows the vehicle to move, the vehicle brake chosen from at least one of a wheel brake, a transmission brake, and a clutch.

4. A throttle actuation system for use during a pre-race staging process for a race vehicle before a race begins, the vehicle including an engine throttle, a driver actuated throttle control, a vehicle brake and a brake switch, comprising:

first means for closing the engine throttle to a preset partial setting while the driver actuated throttle control is in a wide open throttle position; and second means for opening the engine throttle to a wide open setting while the driver actuated throttle control is in the wide open throttle position, wherein the first means and the second means are actuated during a pre-race staging process for a race vehicle before a race begins.

5. The throttle actuation system for use during a pre-race staging process of claim 4, further including:

an initial means for switching between a pro tree mode and a full tree mode, wherein the full tree mode selects a throttle opening delay.

6. The throttle actuation system for use during a pre-race staging process of claim 5, wherein the initial means further includes:

the pro tree mode allows for the second means to open the throttle to the wide open position immediately upon activation of the vehicle brake; and the full tree mode allows for the second means to open the throttle to the wide open position after a preselected time delay from the release of the vehicle brake switch.

7. The throttle actuation system for use during a pre-race staging process of claim 4, further including:

initiating means for activating a pro tree mode, the pro tree mode allows for the second means to open the throttle to the wide open position immediately upon activation of the vehicle brake.

8. The throttle actuation system for use during a pre-race staging process of claim 4, further including:

initiating means for activating a full tree mode, the full tree mode allows for the second means to open the throttle to the wide open position after a preselected time delay from the release of the vehicle brake switch.

9. The throttle actuation system for use during a pre-race staging process of claim 4, further including:

a throttle closing adjustment means for the first means wherein throttle closure can be adjusted.

10. The throttle actuation system for use during a pre-race staging process of claim 4, further including:

a speed adjustment means for the second means wherein the opening rate of the engine throttle is adjustable.

11. The throttle actuation system for use during a pre-race staging process of claim 4, wherein the vehicle brake is chosen from at least one of:

a wheel brake, a transmission brake, and a clutch.

12. A throttle actuation system for use during a pre-race staging process for a race vehicle before a race begins, the vehicle including an engine throttle, a driver actuated throttle control, a vehicle brake and a brake switch, comprising:

a selection means for switching between a pro tree mode and a full tree mode during a pre-racing staging process for a race vehicle before a race begins.

13. The throttle actuation system for use during a pre-race staging process of claim 12, wherein the vehicle brake is chosen from at least one of:

a wheel brake, a transmission brake, and a clutch.

* * * * *

UNITED STATES PATENT AND TRADEMARK OFFICE

CERTIFICATE OF CORRECTION

PATENT NO : 5,855,196

DATED : January 5, 1999

INVENTOR(S) : Hawley

It is certified that error appears in the above-identified patent and that said Letters Patent are hereby corrected as shown below:

| | | | |
|---|---|---|---|
| Re. 32,474 | 08/1987 | Reid | 307/10 |
| 2,840,064 | 08/1954 | Hofer | 123/97 |
| 3,517,653 | 04/1968 | Hajime Ariga, et al. | 123/97 |
| 3,923,020 | 12/1975 | Gilligan | 123/103 |
| 4,286,685 | 09/1981 | Rudolph, et al. | 180/176 |
| 4,362,138 | 12/1982 | Krueger, et al. | 123/342 |
| 4,424,876 | 01/1984 | Filho | 180/175 |
| 4,462,372 | 07/1984 | Jackson | 123/452 |
| 4,467,219 | 08/1984 | Reid | 307/10 R |
| 4,493,303 | 01/1985 | Thompson, et al. | 123/357 |
| 4,556,032 | 12/1985 | Miller | 123/438 |
| 4,574,752 | 03/1986 | Reichert, Jr., et al. | 123/198 DB |
| 4,596,215 | 06/1986 | Palesotti | 123/335 |
| 4,812,671 | 03/1989 | Furrow | 307/10.1 |
| 4,840,157 | 06/1989 | Furrow | 123/352 |
| 4,873,891 | 10/1989 | Guanciale | 74/625 |
| 5,080,619 | 01/1992 | Uchida, et al. | 440/84 |
| 5,200,900 | 04/1993 | Adrain, et al. | 364/431.12 |
| 5,642,712 | 07/1997 | Biondo | 123/398 |

UNITED STATES PATENT AND TRADEMARK OFFICE

CERTIFICATE OF CORRECTION

PATENT NO : 5,855,196

DATED : January 5, 1999

INVENTOR(S) : Hawley

It is certified that error appears in the above-identified patent and that said Letters Patent are hereby corrected as shown below:

National Dragster, "Performance Industry News", National Hot Rod Assoc., May 24, 1985, p. 73

National Dragster, "Dedenbear Products" (Ad.), National Hot Rod Assoc., May 24, 1985 p.90

National Dragster, "The New Solution", (Dedenbear Ad.), National Hot Rod Assoc., Jul. 5, 1985 p. 29

National Dragster, "Race Car Products", (DRC Ad). National Hot Rod Assoc., Aug. 23, 1985 p. 82

National Dragster, "Performance Industry News", National Hot Rod Assoc., Aug. 30, 1985 p. 88

National Dragster, "GT Throttle Stops", (Ad.), National Hot Rod Assoc., Oct. 4, 1985 p. 29

National Dragster, "The Timing System Winning Professionals Depend On", (Dedenbear Ad), National Hot Rod Assoc., Dec. 13, 1985 p. 73

National Dragster, "The Timing System Winning Professionals Depend On", (Dedenbear Ad), National Hot Rod Assoc., Jan. 24, 1986 p. 14

UNITED STATES PATENT AND TRADEMARK OFFICE

CERTIFICATE OF CORRECTION

PATENT NO : 5,855,196

DATED : January 5, 1999

INVENTOR(S) : Hawley

It is certified that error appears in the above-identified patent and that said Letters Patent are hereby corrected as shown below:

National Dragster, "Race Car Products", (DRC Ad. ), National Hot Rod Assoc., Feb. 7, 1986, p. 86

National Dragster, "Introducing The 'Bear Stop' Throttle Stop" (DedenbearAd.), National Hot Rod Assoc., May 9, 1986 p.29

National Dragster, "Larry Reyes' Bullit, Inc.", (Ad.), National Hot Rod Assoc., Jun. 6, 1986 p. 24

National Dragster, "Control Yourself", National Hot Rod Assoc., Jun. 27, 1986 p. 94

National Dragster, "Introducing The 'Bear Stop' Throttle Stop" (Dedenbear Ad.), National Hot Rod Assoc., Jul. 4, 1986 p. 27

National Dragster, "Bullit Now Brings You More", (Ad.), National Hot Rod Assoc., Jul. 25, 1986 p. 48

National Dragster, "The Solution", (Dedenbear Ad), National Hot Rod Assoc., Aug. 29, 1986, p. 78

National Dragster, "Starting Line Problems?", (Ad- Bob's Pro Start), National Hot Rod Assoc., Sept. 26, 1986 p. 46

UNITED STATES PATENT AND TRADEMARK OFFICE

CERTIFICATE OF CORRECTION

PATENT NO : 5,855,196

DATED : January 5, 1999

INVENTOR(S) : Hawley

It is certified that error appears in the above-identified patent and that said Letters Patent are hereby corrected as shown below:

National Dragster, "Dedenbear Products", (Ad.), National Hot Rod Assoc., Sept. 26, 1986, p. 105

National Dragster, "In Drag Racing, Timing is Everything" National Hot Rod Assoc., May 20, 1988 p.18-21, 71

National Dragster, "Stop Losing Races Due to Inconstancy",National Hot Rod Assoc., Apr. 27, 1990 pp. 23-25, 80

Pro Cube, "Installation and Operating Manual", K&R Performance Engineering, Inc., June 1997

Advertisement, "Our New Pro-Cube Delay Box", K&R Performance Engineering, Inc., (no date listed)

Advertisement, "K&R Performance Engineering". K&R Performance Engineering, Inc., (no date listed)

Catalog, "BRP Biondo Racing Products, Inc.", Biondo Racing Products Inc., (no date listed)

Catalog and Technical Guide, "Dedenbear Products, Inc." Dedenbear Products, Inc., (no date listed)

UNITED STATES PATENT AND TRADEMARK OFFICE

CERTIFICATE OF CORRECTION

PATENT NO : 5,855,196

DATED : January 5, 1999

INVENTOR(S) : Hawley

It is certified that error appears in the above-identified patent and that said Letters Patent are hereby corrected as shown below:

Manual, "Installation and Operating Instructions for Transbrake and Throttle Stop Controller Model XTC-200 With Flinch Protection" K&R Performance Engineering, Inc., (no date listed)

Advertisement, "Digital Delay, Inc.", Digital Delay, Inc., (no date listed)

Signed and Sealed this

Eleventh Day of April, 2000

*Attest:*

*Attesting Officer*

Q. TODD DICKINSON

*Director of Patents and Trademarks*